US012503271B2

(12) United States Patent
Chen

(10) Patent No.: US 12,503,271 B2
(45) Date of Patent: Dec. 23, 2025

(54) GIFT BOX PAPERBOARD

(71) Applicant: Dongguan Waching Printing Company Limited, Dongguan (CN)

(72) Inventor: Ke Chen, Chenzhou (CN)

(73) Assignee: Dongguan Waching Printing Company Limited, Dongguan (CN)

( * ) Notice: Subject to any disclaimer, the term of this patent is extended or adjusted under 35 U.S.C. 154(b) by 712 days.

(21) Appl. No.: 17/948,399

(22) Filed: Sep. 20, 2022

(65) Prior Publication Data

US 2024/0043165 A1 Feb. 8, 2024

(30) Foreign Application Priority Data

Aug. 4, 2022 (CN) ..... 202210934870.0

(51) Int. Cl.

| | |
|---|---|
| ***B65D 5/62*** | (2006.01) |
| ***B65D 5/42*** | (2006.01) |
| ***B65D 5/44*** | (2006.01) |
| ***B65D 5/64*** | (2006.01) |

(52) U.S. Cl.

CPC ..... *B65D 5/62* (2013.01); *B65D 5/4295* (2013.01); *B65D 5/446* (2013.01); *B65D 5/643* (2013.01)

(58) Field of Classification Search

CPC ..... B65D 5/62; B65D 5/4295; B65D 5/446; B65D 5/643; B65D 81/127; B65D 2205/00; B65D 25/108; B65D 2313/04; B65D 65/406; B65D 13/04; B65D 25/34; B65D 65/22; B65D 65/40; B65D 81/18; B65D 81/263; B65D 2203/12; B65D 25/10; Y02W 30/80; B31B 50/73

USPC ..... 229/120, 198, 198.1, 198.2, 198.3, 229/125.37, 125.21; 206/818; 220/315; 24/303; 292/251.5; 428/900

See application file for complete search history.

(56) References Cited

U.S. PATENT DOCUMENTS

| | | | | |
|---|---|---|---|---|
| 8,950,656 | B2 * | 2/2015 | Nebeker | B65D 5/425 229/162.1 |
| 10,053,274 | B1 * | 8/2018 | O'Neill | B65D 5/4291 |
| 10,364,060 | B2 * | 7/2019 | Etem | B65D 5/4287 |
| 2015/0321811 | A1 * | 11/2015 | Yeung | A47B 87/0284 220/23.83 |
| 2018/0339798 | A1 * | 11/2018 | Etem | B65D 5/62 |

FOREIGN PATENT DOCUMENTS

| | | | |
|---|---|---|---|
| CN | 210527165 U | * | 5/2020 |
| CN | 212046133 U | | 12/2020 |
| CN | 215476567 U | | 1/2022 |
| CN | 216579380 U | | 5/2022 |

* cited by examiner

*Primary Examiner* — Christopher R Demeree
(74) *Attorney, Agent, or Firm* — Nitin Kaushik

(57) ABSTRACT

The present disclosure relates to the technical field of gift box paperboards, and provides a novel gift box paperboard, including a first box body. A first paperboard is arranged on one side of the first box body. A clamping block is fixedly connected to the bottom of the first paperboard. A second paperboard is arranged on one side of the first paperboard. A clamping groove used in cooperation with the clamping block is formed in one side of the second paperboard. The problem that paperboard boxes are very cumbersome to make and cannot be massively produced due to inconvenient connection between paperboards in related technologies is solved.

8 Claims, 6 Drawing Sheets

GIFT BOX PAPERBOARD

CROSS-REFERENCE TO RELATED APPLICATIONS

The application claims priority to Chinese patent application No. 2022109348700, filed on Aug. 4, 2022, the entire contents of which are incorporated herein by reference.

FIELD OF TECHNOLOGY

The present disclosure relates to the technical field of gift box paperboards, in particular to a novel gift box paperboard.

BACKGROUND

A paperboard, as a common material for a paper packaging box, has a certain thickness and generally includes core paper positioned in the middle and surface paper and lining paper positioned on two sides of the core paper. Specifically, when the paperboard is made into a carton, the lining paper is positioned inside the carton, and the surface paper is positioned outside the carton. During gift giving, paperboard boxes are often needed to package gifts. Existing paperboards are inconvenient to connect, so paperboard boxes are very cumbersome to make and cannot be massively produced.

SUMMARY

The present disclosure provides a novel gift box paperboard, and solves the problem that paperboard boxes are very cumbersome to make and cannot be massively produced due to inconvenient connection between paperboards in related technologies.

A technical solution of the present disclosure is as follows: a novel gift box paperboard, including a first box body, where a first paperboard is arranged on one side of the first box body, a clamping block is fixedly connected to the bottom of the first paperboard, a second paperboard is arranged on one side of the first paperboard, a clamping groove used in cooperation with the clamping block is formed in one side of the second paperboard, a rotating shaft is fixedly connected to the bottom of the second paperboard, a baffle is rotatably connected to an outer wall of the rotating shaft, a third paperboard is arranged on the other side of the second paperboard, a fourth paperboard is arranged at the top of the third paperboard, a second box body is rotatably connected to one side of the first box body, a first magnet is arranged at the top of the first box body, a second magnet is arranged on an outer wall of the second box body, and the first magnet and the second magnet have opposite magnetic poles.

Preferably, a waterproof layer is arranged on an outer wall of each of the first paperboard, the second paperboard, the third paperboard, and the fourth paperboard, a ventilation layer is arranged on an inner wall of the waterproof layer, a buffer layer is arranged on an inner wall of the ventilation layer, a reinforcement layer is arranged on an inner wall of the buffer layer, the first box body and the second box body are made of corrugated paper, and three-in-one white glue is arranged on an outer wall of each of the first box body and the second box body.

Preferably, the waterproof layer is made from polyethylene.

Preferably, circular grooves are equidistantly formed inside the ventilation layer.

Preferably, the inside of the buffer layer is made of a triangular plate.

Preferably, the reinforcement layer is made from high-pressure wood fibers.

Preferably, a first magnet is fixedly connected to one side of the fourth paperboard, a second magnet is fixedly connected to a side of the first paperboard close to the fourth paperboard, and the first magnet and the second magnet are magnetically opposite.

Preferably, a third magnet is fixedly connected to one side of the fourth paperboard, a fourth magnet is fixedly connected to a side of the first paperboard close to the fourth paperboard, and the third magnet and the fourth magnet are magnetically opposite.

Preferably, a through groove is formed inside the fourth paperboard, a reinforcement ring is fixedly connected to an inner wall of the through groove, a rotating block is fixedly connected to an inner wall of the reinforcement ring, a rotating plate is rotatably connected to one end of the rotating block, a second inclined block is fixedly connected to the top of the rotating plate, a first inclined block is fixedly connected to the inner wall of the reinforcement ring and positioned above the rotating block, and a spring is arranged between the first inclined block and the second inclined block.

The present disclosure has the following beneficial effects:

In the present disclosure, the first magnet and the second magnet are adsorbed together due to opposite magnetic poles, such that the first box body and the second box body are convenient to install; the first box body and the second box body are made of the corrugated paper, such that the material and quality are good, and a box in the hand is just right in weight, not too heavy or too light, environmentally friendly, and not flashy without substance; the second paperboard is placed on the clamping block at the bottom of the first paperboard, and at this time the clamping groove is in clamped connection with the clamping block, such that the first paperboard and the second paperboard are convenient to quickly connect; the baffle is rotated to abut against a joint between the clamping block and the clamping groove, such that the clamping block may be prevented from being separated from the clamping groove; and the structure enables the first paperboard and the second paperboard to be installed stably and facilitates the assembly of the gift box.

BRIEF DESCRIPTION OF THE DRAWINGS

The present disclosure will be further described in detail below with reference to the accompanying drawings and specific implementations.

In which: 1: first paperboard; 2: second paperboard; 3: third paperboard; 4: fourth paperboard; 5: through groove; 6: fixing plate; 7: rubber plate; 8: sponge plate; 9: groove; 10: first magnet; 11: second magnet; 12: clamping groove; 13: clamping block; 14: rotating shaft; 15: baffle; 16: waterproof layer; 17: ventilation layer; 18: buffer layer; 19: reinforcement layer; 20: rotating block; 21: reinforcement ring; 22: first inclined block; 23: spring; 24: second inclined block; 25: rotating plate; 26: first box body; 27: second box body; 28: third magnet; and 29: fourth magnet.

DESCRIPTION OF THE EMBODIMENTS

In which: 1: first paperboard; 2: second paperboard; 3: third paperboard; 4: fourth paperboard; 5: through groove; 6: fixing plate; 7: rubber plate; 8: sponge plate; 9: groove; 10: third magnet; 11: fourth magnet; 12: clamping groove; 13: clamping block; 14: rotating shaft; 15: baffle; 16: waterproof layer; 17: ventilation layer; 18: buffer layer; 19: reinforcement layer; 20: rotating block; 21: reinforcement ring; 22: first inclined block; 23: spring; 24: second inclined block; 25: rotating plate; 26: first box body; 27: second box body; 28: first magnet; and 29: second magnet.

Embodiment 1

Figure 1:
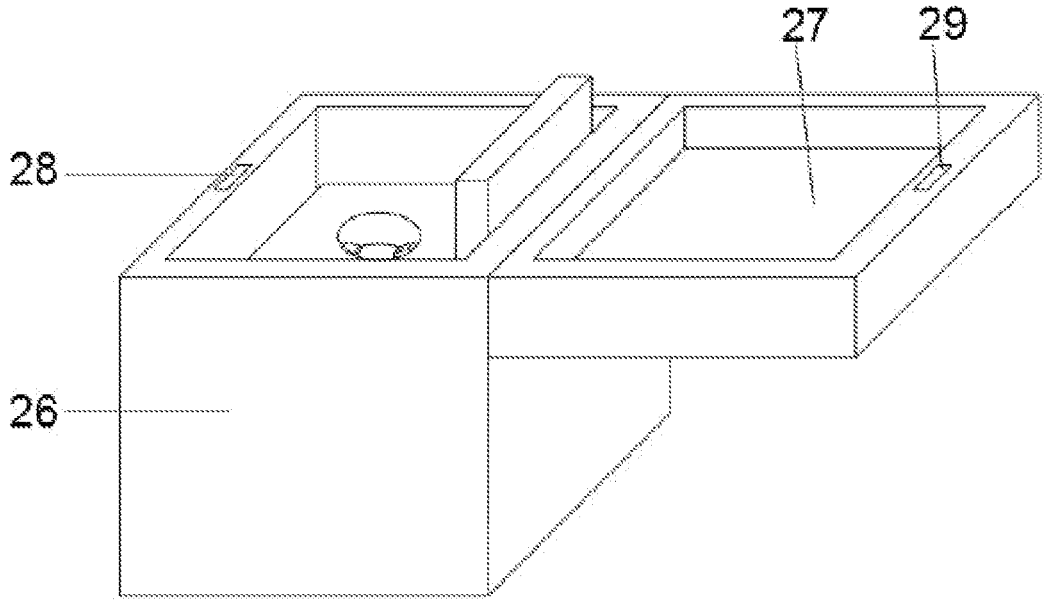
FIG. 1 is a three-dimensional diagram of the present disclosure.
Figure 2:
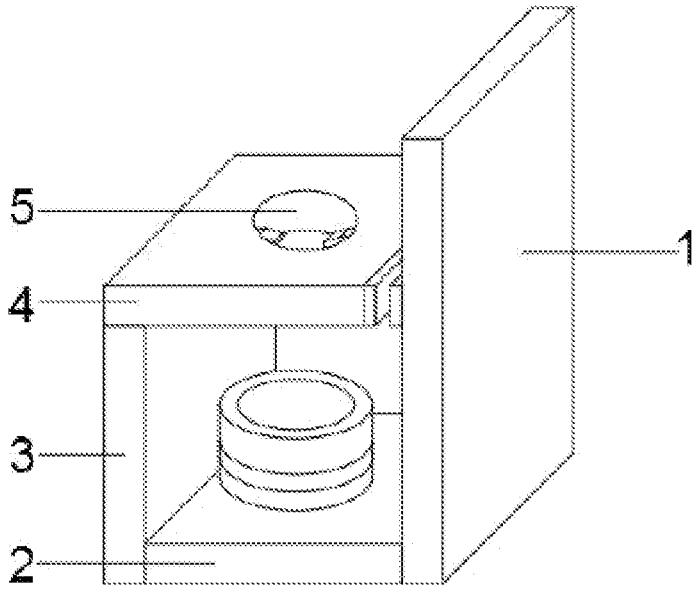
FIG. 2 is a three-dimensional diagram of cooperative use of a first paperboard, a second paperboard, a third paperboard, and a fourth paperboard in the present disclosure.
Figure 3:
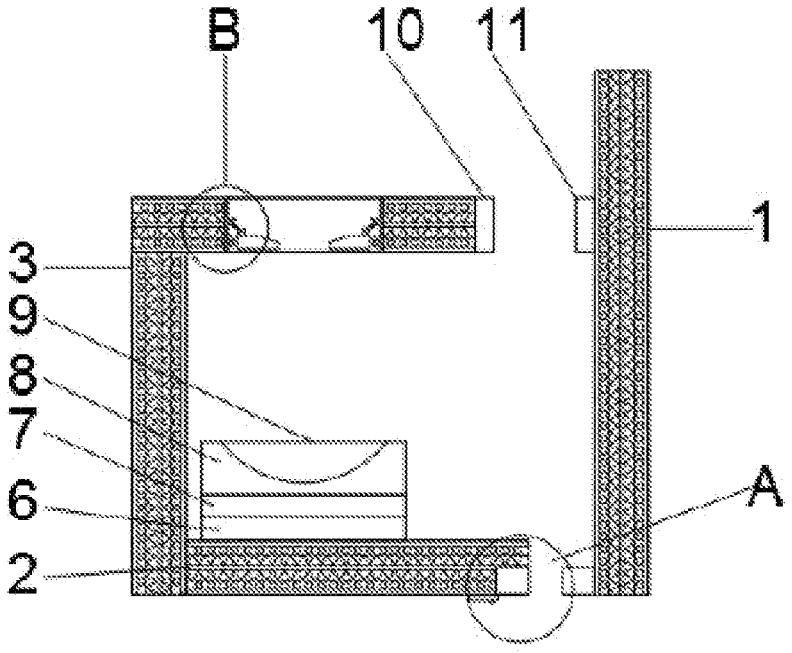
FIG. 3 is a cross-sectional view of cooperative use of the first paperboard, the second paperboard, the third paperboard, and the fourth paperboard in the present disclosure.
Figure 4:
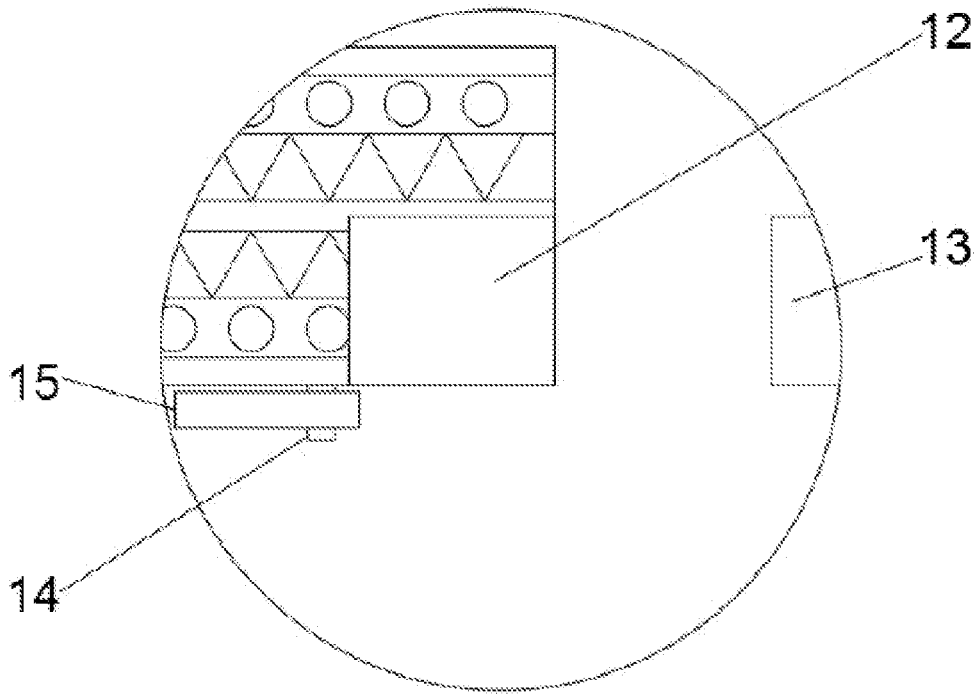
FIG. 4 is an enlarged view of A in the present disclosure.
Figure 5:
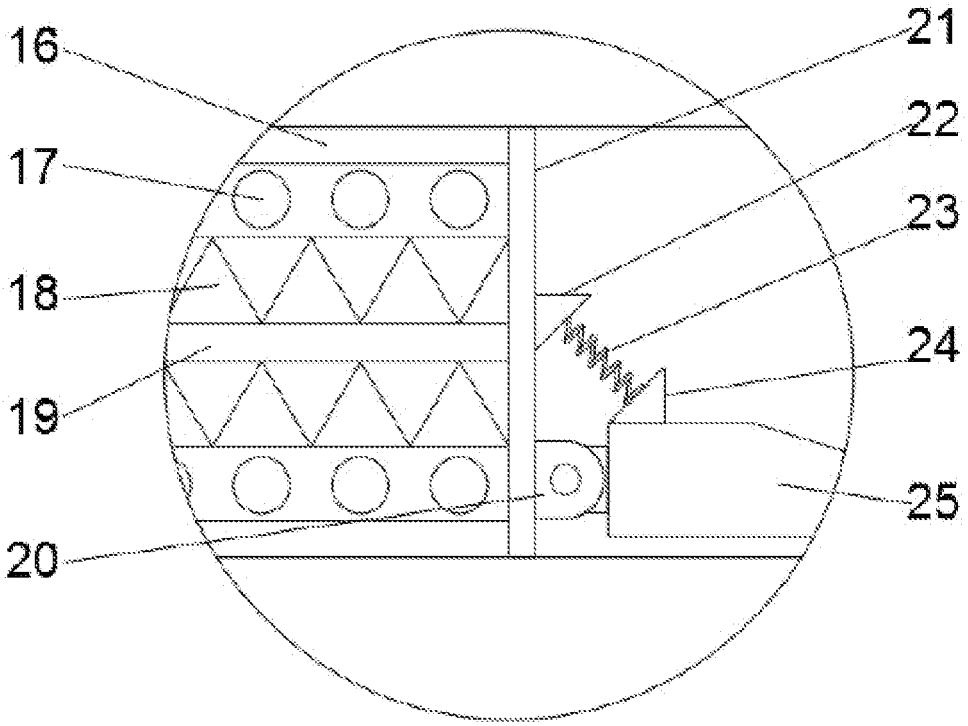
FIG. 5 is an enlarged view of B in the present disclosure.
Figure 6:
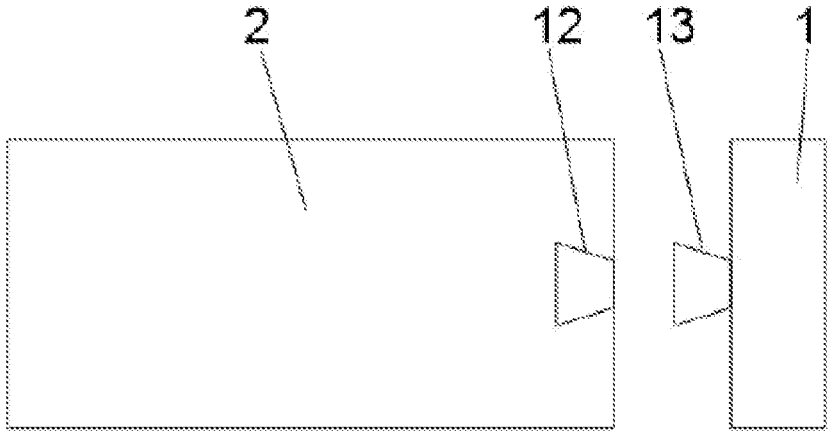
FIG. 6 is a diagram of cooperative use of a clamping groove and a clamping block in the present disclosure.

As shown in FIGS. 1 to 5, this embodiment provides a novel gift box paperboard, including a first box body 26, where a first paperboard 1 is arranged on one side of the first box body 26, a clamping block 13 is fixedly connected to the bottom of the first paperboard 1, a second paperboard 2 is arranged on one side of the first paperboard 1, a clamping groove 12 used in cooperation with the clamping block 13 is formed in one side of the second paperboard 2, a rotating shaft 14 is fixedly connected to the bottom of the second paperboard 2, a baffle 15 is rotatably connected to an outer wall of the rotating shaft 14, a third paperboard 3 is arranged on the other side of the second paperboard 2, a fourth paperboard 4 is arranged at the top of the third paperboard 3, a second box body 27 is rotatably connected to one side of the first box body 26, a first magnet 28 is arranged at the top of the first box body 26, a second magnet 29 is arranged on an outer wall of the second box body 27, and the first magnet 28 and the second magnet 29 have opposite magnetic poles.

In this embodiment, the first paperboard 1 is installed on one side of an inner wall of the first box body 26, the second paperboard 2 is placed on the clamping block 13 at the bottom of the first paperboard 1, and at this time the clamping groove 12 is in clamped connection with the clamping block 13, such that the first paperboard 1 and the second paperboard 2 are convenient to quickly connect; the baffle 15 is rotated to abut against a joint between the clamping block 13 and the clamping groove 12, such that the clamping block 13 may be prevented from being separated from the clamping groove 12; the structure enables the first paperboard 1 and the second paperboard 2 to be installed stably and facilitates the assembly of a gift box; by arranging the second box body 27, a gift inside may be better protected; and the first magnet 28 and the second magnet 29 are adsorbed together due to opposite magnetic poles, such that the first box body 26 and the second box body 27 are convenient to install.

Embodiment 2

As shown in FIGS. 1 to 5, based on the same concept as the above-mentioned Embodiment 1, it is further proposed in this embodiment that a waterproof layer 16 is arranged on an outer wall of each of the first paperboard 1, the second paperboard 2, the third paperboard 3, and the fourth paperboard 4, a ventilation layer 17 is arranged on an inner wall of the waterproof layer 16, a buffer layer 18 is arranged on an inner wall of the ventilation layer 17, a reinforcement layer 19 is arranged on an inner wall of the buffer layer 18, the first box body 26 and the second box body 27 are made of corrugated paper, and three-in-one white glue is arranged on an outer wall of each of the first box body 26 and the second box body 27; the waterproof layer 16 is made from polyethylene; circular grooves are equidistantly formed inside the ventilation layer 17; the inside of the buffer layer 18 is made of a triangular plate; the reinforcement layer 19 is made from high-pressure wood fibers; a third magnet 10 is fixedly connected to one side of the fourth paperboard 4, a fourth magnet 11 is fixedly connected to a side of the first paperboard 1 close to the fourth paperboard 4, and the first third magnet 10 and the fourth magnet 11 are magnetically opposite; a fixing plate 6 is fixedly connected to the top of the second paperboard 2, a rubber plate 7 is fixedly connected to the top of the fixing plate 6, a sponge plate 8 is fixedly connected to the top of the rubber plate 7, and a groove 9 is formed in the top of the sponge plate 8; and a through groove 5 is formed inside the fourth paperboard 4, a reinforcement ring 21 is fixedly connected to an inner wall of the through groove 5, a rotating block 20 is fixedly connected to an inner wall of the reinforcement ring 21, a rotating plate 25 is rotatably connected to one end of the rotating block 20, a second inclined block 24 is fixedly connected to the top of the rotating plate 25, a first inclined block 22 is fixedly connected to the inner wall of the reinforcement ring 21 and positioned above the rotating block 20, and a spring 23 is arranged between the first inclined block 22 and the second inclined block 24.

In this embodiment, after the first paperboard 1 is connected to the second paperboard 2, the fourth paperboard 4 is placed close to the first paperboard 1, and the third magnet 10 and the fourth magnet 11 are adsorbed together due to opposite magnetic poles, such that the first paperboard 1 and the fourth paperboard 4 may be quickly fixed; by the waterproof layer 16 made from the polyethylene, the gift box may be prevented from being damaged by damp; by forming the circular groove in the ventilation layer 17, the air permeability of the first paperboard 1, the second paperboard 2, the third paperboard 3, and the fourth paperboard 4 is better, and the peculiar smell is prevented from being produced inside the gift box; by the buffer layer 18 made of the triangular plate, the gift box is well buffered when impacted to prevent the gift inside from being damaged; by the reinforcement layer 19 made from the high-pressure wood fibers, the first paperboard 1, the second paperboard 2, the third paperboard 3, and the fourth paperboard 4 have higher hardness and better force bearing performance; the first box body 26 and the second box body 27 are made of the corrugated paper, such that the material and quality are good, and the box in the hand is just right in weight, not too heavy or too light, environmentally friendly, and not flashy without substance; the three-in-one white glue is a professional adhesive, has a better sticking effect on paper, and may be subjected to manual or spray construction; the spray construction can enable the paperboard to be sprayed with a large area of the three-in-one white glue evenly, and the three-in-one white glue used for this box has the effect of quick drying; the gift is put into the through groove 5 and placed on the groove 9; by the sponge plate 8, the gift may be protected, and the gift box is prevented from vibrating during shaking to damage the gift; and when the gift passes through the through groove 5, the rotating plate 25 is pushed to rotate to abut against a side surface of the gift, and at the same time the rotating plate 25 is pulled by the spring 23 to abut against the side surface of the gift to prevent the gift from shaking in the gift box.

The above are merely the preferred embodiments of the present disclosure and are not intended to limit the present disclosure. Any modifications, equivalent replacements, improvements, etc. made within the spirit and principle of the present disclosure shall fall within the scope of protection of the present disclosure.

What is claimed is:

1. A novel gift box paperboard, comprising a first box body, a first paperboard being arranged on one side of the first box body, a clamping block being fixedly connected to a bottom of the first paperboard, a second paperboard being arranged on one side of the first paperboard, a clamping groove used in cooperation with the clamping block being formed in one side of the second paperboard, a rotating shaft being fixedly connected to a bottom of the second paperboard, a baffle being rotatably connected to an outer wall of the rotating shaft, a third paperboard being arranged on the other side of the second paperboard, a fourth paperboard being arranged at a top of the third paperboard, a second box body being rotatably connected to one side of the first box body, a first magnet being arranged at a top of the first box body, a second magnet being arranged on an outer wall of the second box body, and the first magnet and the second magnet having opposite magnetic poles, wherein a waterproof layer is arranged on an outer wall of each of the first paperboard, the second paperboard, the third paperboard, and the fourth paperboard, a ventilation layer is arranged on an inner wall of the waterproof layer, a buffer layer is arranged on an inner wall of the ventilation layer, a reinforcement layer is arranged on an inner wall of the buffer layer, the first box body and the second box body are made of corrugated paper, and three-in-one white glue is arranged on an outer wall of each of the first box body and the second box body.

2. The novel gift box paperboard according to claim 1, wherein the waterproof layer is made from polyethylene.

3. The novel gift box paperboard according to claim 1, wherein circular grooves are equidistantly formed inside the ventilation layer.

4. The novel gift box paperboard according to claim 1, wherein an inside of the buffer layer is made of a triangular plate.

5. The novel gift box paperboard according to claim 1, wherein the reinforcement layer is made from high-pressure wood fibers.

6. The novel gift box paperboard according to claim 1, wherein a third magnet is fixedly connected to one side of the fourth paperboard, a fourth magnet is fixedly connected to a side of the first paperboard close to the fourth paperboard, and the third magnet and the fourth magnet are magnetically opposite.

7. A novel gift box paperboard, comprising a first box body, a first paperboard being arranged on one side of the first box body, a clamping block being fixedly connected to a bottom of the first paperboard, a second paperboard being arranged on one side of the first paperboard, a clamping groove used in cooperation with the clamping block being formed in one side of the second paperboard, a rotating shaft being fixedly connected to a bottom of the second paperboard, a baffle being rotatably connected to an outer wall of the rotating shaft, a third paperboard being arranged on the other side of the second paperboard, a fourth paperboard being arranged at a top of the third paperboard, a second box body being rotatably connected to one side of the first box body, a first magnet being arranged at a top of the first box body, a second magnet being arranged on an outer wall of the second box body, and the first magnet and the second magnet having opposite magnetic poles, wherein a fixing plate is fixedly connected to a top of the second paperboard, a rubber plate is fixedly connected to a top of the fixing plate, a sponge plate is fixedly connected to a top of the rubber plate, and a groove is formed in a top of the sponge plate.

8. A novel gift box paperboard, comprising a first box body, a first paperboard being arranged on one side of the first box body, a clamping block being fixedly connected to a bottom of the first paperboard, a second paperboard being arranged on one side of the first paperboard, a clamping groove used in cooperation with the clamping block being formed in one side of the second paperboard, a rotating shaft being fixedly connected to a bottom of the second paperboard, a baffle being rotatably connected to an outer wall of the rotating shaft, a third paperboard being arranged on the other side of the second paperboard, a fourth paperboard being arranged at a top of the third paperboard, a second box body being rotatably connected to one side of the first box body, a first magnet being arranged at a top of the first box body, a second magnet being arranged on an outer wall of the second box body, and the first magnet and the second magnet having opposite magnetic poles, wherein a through groove is formed inside the fourth paperboard, a reinforcement ring is fixedly connected to an inner wall of the through groove, a rotating block is fixedly connected to an inner wall of the reinforcement ring, a rotating plate is rotatably connected to one end of the rotating block, a second inclined block is fixedly connected to a top of the rotating plate, a first inclined block is fixedly connected to the inner wall of the reinforcement ring and positioned above the rotating block, and a spring is arranged between the first inclined block and the second inclined block.

* * * * *